United States Patent [19]

Peters

[11] Patent Number: 4,488,724

[45] Date of Patent: Dec. 18, 1984

[54] HORIZONTALLY MOVABLE KICKER FOR PIN BALL GAME

[75] Inventor: Albin Peters, Chicago, Ill.

[73] Assignee: Wico Corporation, Niles, Ill.

[21] Appl. No.: 338,314

[22] Filed: Jan. 11, 1982

[51] Int. Cl.[3] ..... A63F 7/00

[52] U.S. Cl. ..... 273/129 S; 200/61.11

[58] Field of Search ..... 273/129 R, 129 V, 123 R, 273/125 R, 120 R, 120 A, 119 R, 119 A, 121 A, 121 D, 122 A, 123 A, 124 A, 125 A, 129 S, 85 F; 200/61.11; 124/54

[56] References Cited

U.S. PATENT DOCUMENTS

| | | | |
|---|---|---|---|
| 2,035,271 | 3/1936 | MacDougall | 273/121 A |
| 3,675,927 | 7/1972 | Gottlieb et al. | 273/119 A |
| 3,820,788 | 6/1974 | Goldfarb et al. | 273/129 S |
| 4,109,916 | 8/1978 | Breslow et al. | 273/121 A |
| 4,119,314 | 10/1978 | Moena | 273/85 F |
| 4,162,793 | 7/1979 | Cummings | 273/121 A |
| 4,203,602 | 5/1980 | Kral | 273/129 V |
| 4,240,634 | 12/1980 | Wiczer | 273/127 R |
| 4,300,769 | 11/1981 | Momura | 273/129 V |
| 4,311,311 | 1/1982 | Crosman | 273/121 A |

*Primary Examiner*—Richard C. Pinkham
*Assistant Examiner*—T. Brown
*Attorney, Agent, or Firm*—Emrich & Dithmar

[57] ABSTRACT

A kicker apparatus for a slingshot bumper assembly in a pin ball game including a playfield board on which a ball rolls for engagement with a resilient impact band to actuate a drive solenoid, includes a frame which mounts the solenoid with its plunger axis perpendicular to the playfield board and which pivotally supports a drive crank having one end connected to the solenoid plunger and the other end projecting above the playfield board. A kicker member is loosely fitted over the upper end of the crank and has guide feet respectively slidably received in a pair of track channels in the frame for reciprocating movement along a path parallel to the playfield board in response to the pivotal movement of the crank for engagement with the impact band to impart a propelling force to the ball in a direction substantially parallel to the playfield board.

22 Claims, 7 Drawing Figures

FIG. 1
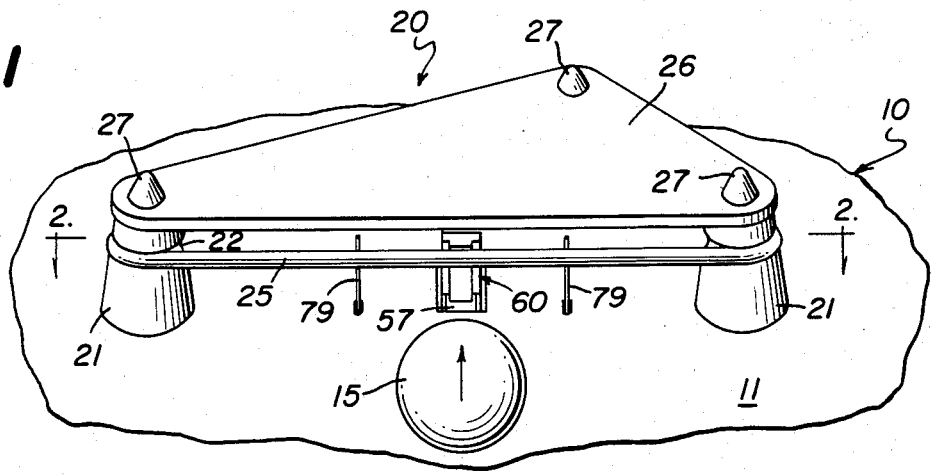
FIG. 2
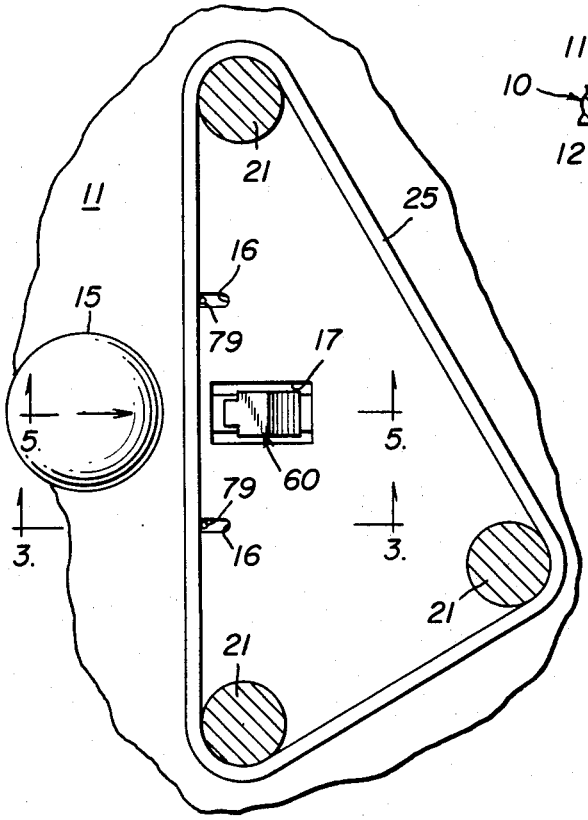
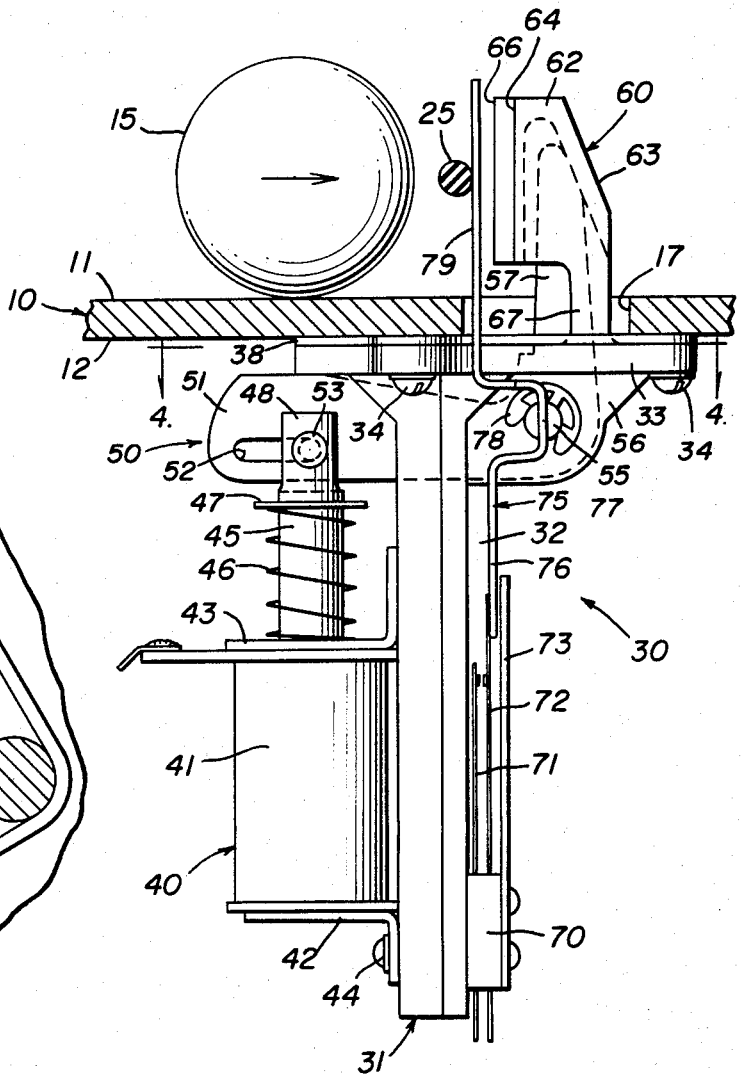
FIG. 3

HORIZONTALLY MOVABLE KICKER FOR PIN BALL GAME

BACKGROUND OF THE INVENTION

The present invention relates to ball bumpers for a ball rolling game and, in particular, to a slingshot-type bumper assembly for an electromechanical pin ball game. A slingshot-type bumper assembly typically includes an elastic band tensioned around a plurality of posts a slight distance above the playfield board and adapted for engagement by a rolling pin ball. In order to accelerate the ball as it rebounds from the resilient band, there is also provided a kicker apparatus which is actuated in response to impact of the ball on the resilient band for triggering a kicker into engagement with the inner side of the band to impart a propelling force to the pin ball which is substantially greater than the force which could have been imparted by the deflected band itself.

Typically, the kicker apparatus includes a solenoid mounted vertically beneath the playfield board and having its plunger connected to one end of a crank, the other end of which projects above the playfield board for engagement with the elastic band. An actuator is disposed in engagement with the band for movement thereby when a ball impacts on the band to close a switch for actuating the solenoid pivotally to move the kicker crank into engagement with the band.

A drawback of this type of kicker apparatus is that, because the kicker crank moves pivotally it is inclined at an acute angle to the playfield board at the point of impact with the resilient band and therefore imparts to the band and the ball a force which is directed downwardly toward the playfield board. This has the disadvantageous results of tending to impart spin or English to the pin ball and producing excessive wear of the playfield board immediately adjacent to the elastic band.

One type of kicker assembly, manufactured by the Bally Corporation, has attempted to overcome these disadvantages by orienting the drive solenoid parallel to the playfield board and having it reciprocate a drive arm rather than pivot a crank. While this avoids the problem of imparting a downward kicking force to the ball, it introduces another problem of wear and inefficient operation of the solenoid, the plunger of which will now lie on its side in frictional engagement with the solenoid core bushing.

SUMMARY OF THE INVENTION

It is a general object of the present invention to provide an improved kicker apparatus for a slingshot-type bumper assembly, which avoids the disadvantages of prior kicker apparatuses while affording additional structural and operating advantages.

An important object of the invention is the provision of a kicker apparatus which imparts to the pin ball a kicking force directed substantially parallel to the playfield board, without inducing undue wear and inefficiency in the operation of the drive solenoid.

Another object of this invention is to provide a kicker apparatus of the type set forth which permits a kicker member to be driven parallel to the playfield board by a substantially vertically-oriented drive solenoid.

Another object of the invention is the provision of a kicker apparatus of the type set forth, which is of simple and economical construction.

These and other objects of the invention are attained by providing a pin ball kicker apparatus comprising a frame, a drive solenoid carried by the frame and having a reciprocating plunger, a kicker member carried by the frame for reciprocating movement with respect thereto along a path extending substantially perpendicular to the axis of the solenoid plunger, and drive linkage means carried by the frame and interconnecting the drive solenoid plunger and the kicker member and responsive to actuation of the drive solenoid for effecting movement of the kicker member along the path.

The invention consists of these and other novel features and a combination of parts hereinafter fully described, illustrated in the accompanying drawings, and particularly pointed out in the appended claims, it being understood that various changes in the details may be made without departing from the spirit, or sacrificing any of the advantages of the invention.

BRIEF DESCRIPTION OF THE DRAWINGS

FIG. 1 is a perspective view of a pin ball game bumper assembly utilizing a kicker apparatus constructed in accordance with and embodying the features of the present invention;

FIG. 2 is a view in horizontal section taken along the line 2—2 in FIG. 1 and rotated 90 degrees clockwise;

FIG. 3 is an enlarged view in vertical section taken along the line 3—3 in FIG. 2 and illustrating the kicker apparatus of the present invention in side elevation in its normal rest position;

SUMMARY OF THE INVENTION

Figure 4:
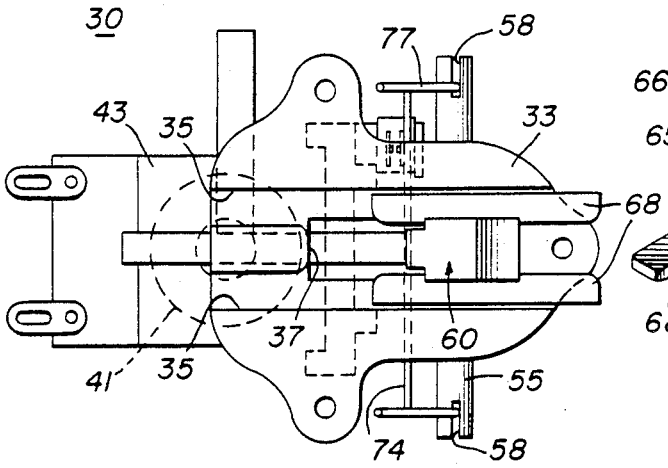
FIG. 4 is a view of the kicker apparatus taken along the line 4—4 in FIG. 3.
Figure 7:
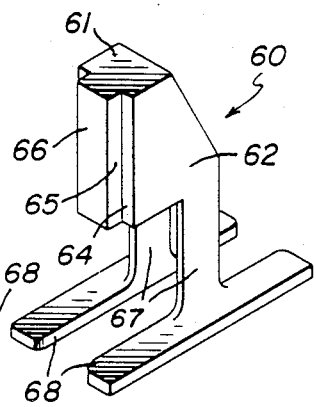
FIG. 7 is a perspective view of the kicker member of the present invention.

Referring to FIGS. 1 through 3 of the drawings, there is illustrated a portion of a pin ball game playfield board, generally designated by the numeral 10, having flat parallel upper and lower surfaces 11 and 12. In use, a pin ball 15 rolls along the upper surface 11 of the playfield board 10 for engagement with a number of targets, in a well known manner. One such target is illustrated in the drawings and comprises a slingshot bumper assembly, generally designated by the numeral 20. Formed in the playfield board 10 are two small apertures 16 and a large rectangular aperture 17 therebetween for cooperation with the bumper assembly 20 in a manner to be described below.

The bumper assembly 20 includes three upstanding posts 21 arranged in a generally triangular configuration and fixedly secured to the playfield board 10. The posts 21 project upwardly above the playfield board 10 and are provided with grooves 22 extending circumferentially therearound for receiving therein an elastic band 25 which is stretched around the three posts 21 and supported thereon so that the transverse center of the band 25 is disposed above the upper surface 11 of the playfield board 10 a predetermined distance preferably substantially equal to the radius of the pin ball 15. The bumper assembly 20 is covered with a triangular cover plate 26 which is supported on the posts 21 and secured thereto by suitable retainers 27 and overlies the apertures 16 and 17 in the playfield board 10.

Figure 5:
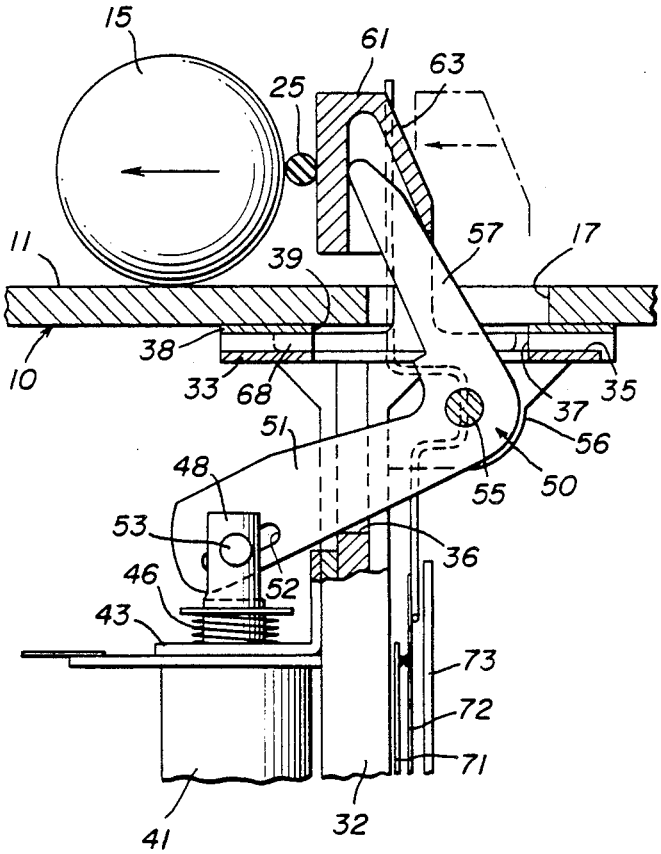
FIG. 5 is an enlarged view in vertical section taken along the line 5—5 in FIG. 2 and illustrating the kicker apparatus in its actuated or kicking position.
Figure 6:
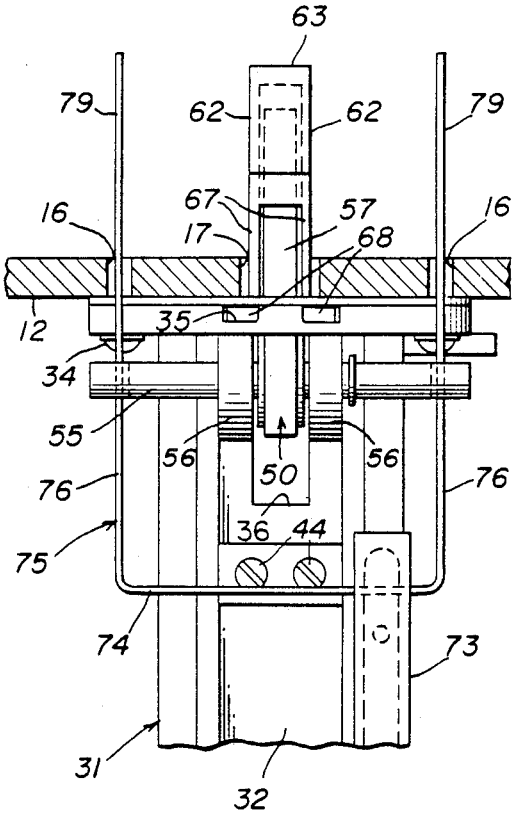
FIG. 6 is a fragmentary elevational view of the kicker apparatus illustrated in FIG. 3, as viewed from the right-hand side thereof.

Referring now also to FIGS. 4 through 6 of the drawings, the bumper assembly 20 includes a kicker apparatus generally designated by the numeral 30, which is disposed beneath the playfield board 10. More particularly, the kicker apparatus 30 includes a frame 31 having a generally rectangular mainplate 32 which is disposed substantially perpendicular to the playfield board 10 and has fixedly secured thereto at the upper end thereof a flat, irregular attachment plate 33 adapted to be fixedly secured to the lower surface 12 of the playfield board 10 by suitable fasteners 34. Formed in the upper surface of the attachment plate 33 are two parallel, spaced-apart, elongated track channels 35, each being generally rectangular in transverse cross section and extending the length of the attachment plate 33. When the frame 31 is secured to the playfield board 10, the track channels 35 cooperate to define a path extending substantially parallel to the playfield board 10.

The mainplate 32 has formed therein at the upper end thereof a rectangular opening or notch 36 (FIGS. 5 and 6) which communicates with a large rectangular opening 37 in the attachment plate 33, the latter opening being disposed in registry with the aperture 17 in the playfield board 10 when the frame 31 is mounted in place thereon. A flat cover plate 38 overlies the attachment plate 33 substantially congruent therewith and is fixedly secured in place between the attachment plate 33 and the playfield board 10 by the fasteners 34. The cover plate 38 has a rectangular opening 39 therein (see FIG. 5) which is disposed in registry with the opening 37 in the attachment plate 33.

The kicker apparatus 30 also includes a drive solenoid generally designated by the numeral 40, which includes a coil 41, the opposite ends of which are respectively secured to bottom and top brackets 42 and 43, which are in turn fixedly secured, as by fasteners 44, to the mainplate 32 of the frame 31 (see FIG. 3). The solenoid 40 has a plunger rod or armature 45, the solenoid 40 being oriented so that the plunger rod 45 projects upwardly therefrom with the axis thereof disposed substantially perpendicular to the playfield board 10. A compression spring 46 is disposed in surrounding relationship with the plunger rod 45 and is retained thereon between the top bracket 43 and an E-ring retainer 47.

The upper end of the plunger rod 45 is formed as a clevis 48 which receives therein one arm 51 of a drive crank 50. More particularly, the arm 51 has an elongated slot 52 therethrough in which is received a coupling pin 53 for pivotally coupling the arm 51 to the clevis 48. The drive crank 50 is disposed between spaced-apart mounting lugs 56 on the frame 31 and is adapted for pivotal movement about the axis of a pivot pin 55 which extends through the mounting lugs 56 and through a complementary opening in the drive crank 50. Preferably, the pivot pin 55 is disposed below the attachment plate 33 and with the axis thereof disposed substantially parallel to the playfield board 10 and perpendicular to the path defined by the track channels 35. The opposite ends of the pivot pin 55 have slots 58 (see FIG. 4) formed therein for a purpose to be described below. The other arm 57 of the drive crank 50 projects upwardly through the openings 39 and 37 and the aperture 17 and extends well above the playfield board 10.

The kicker apparatus 30 also includes a kicker member 60 which generally defines an open-bottom box or receptacle including a top wall 61, a pair of parallel side walls 62, a sloping rear wall 63 and a front wall 64. Projecting forwardly from the front wall 64 along the entire vertical extent thereof is a projection 65 having a rectangular flat bearing surface 66 at the forward end thereof. Respectively integral with the side walls 62 and depending therefrom are spaced-apart parallel legs 67, each integral at the lower end thereof with an elongated rail foot 68 extending substantially perpendicular thereto. In use, the receptacle portion of the kicker member 60 is fitted over the upper end of the drive crank arm 57, with the legs 67 extending down along opposite sides of the drive crank arm 57, and with the rail feet 68 being respectively disposed in the track channels 35 for sliding movement therealong. The thickness of the rail feet 68 is substantially equal to the depth of the track channels 35 so that the rail feet 68 can fit between the track channels 35 and the cover plate 38, it being appreciated that in assembly the kicker member 60 will be mounted in place before attachment of the cover plate 38.

The kicker appratus 30 also includes an electric switch 70 which is fixedly secured to the mainplate 32 of the frame 31 and is provided with a relatively short leaf contact 71 and a relatively long leaf contact 72 and an elongated rectangular guard plate 73. Disposed between the leaf contact 72 and the guard plate 73 is the bight portion 74 (see FIGS. 5 and 6) of a generally U-shaped actuator member 75. Integral with the bight portion 74 at the opposite ends thereof and projecting upwardly therefrom are two arms 76, each provided intermediate the ends thereof with a rearwardly offset portion 77 received in a corresponding one of the slots 58 in the pivot pin 55. The upper ends 79 of the arms 76 respectively project upwardly through the small apertures 16 in the playfield board 10 and extend at least to the level of the elastic band 25. The actuator 75 is resiliently urged by the leaf contact 72 into a normal rest position (illustrated in FIGS. 2 and 3), wherein the upper ends 79 of the arms 76 are disposed in engagement with the inner surface of the elastic band 25.

In operation, when the kicker apparatus 30 is at rest, it is disposed in the position illustrated in FIGS. 3 and 6, with the contacts of the switch 70 open, with the solenoid plunger rod 45 being held in its fully extended position by the compression spring 46, with the drive crank arm 57 extending generally vertically and with the kicker member 60 spaced from the elastic band 25. When a pin ball 15 rolls into engagement with the elastic band 25, as indicated by the arrows in FIGS. 1–3, it will deflect the band 25, thereby pivoting the actuator 75 in a clockwise direction, as viewed in FIG. 3, about the axis of the pivot pin 55, thereby to close the contacts 71 and 72 of the switch 70. It will be appreciated that the terminals of the solenoid coil 41 are connected through the switch 70 to a suitable source of electric power. Thus, upon closure of the contacts of the switch 70, the solenoid coil 41 will be energized, thereby to retract the plunger rod 45 against the urging of the compression spring 46 and move the kicker apparatus 30 to the position illustrated in FIG. 5.

In particular, the downward vertical movement of the plunger rod 45 will pivot the drive crank 50 in a counterclockwise direction, as viewed in FIG. 5, about the axis of the pivot pin 55, thereby to move the upper end of the drive crank arm 57 downwardly and forwardly in a well known manner. The drive crank arm 57 is disposed in sliding engagement with the inner surface of the kicker member 60 so that the pivotal movement of the drive crank arm 57 operates to slide the kicker member 60 horizontally forwardly along the path defined by the track channels 35, parallel to the playfield board 10, in the direction of the broken arrow in FIG. 5. In this manner, the bearing surface 66 of the kicker member 60 is moved horizontally into engagement with the elastic band 25 for moving it outwardly and thereby imparting to the pin ball 15 an accelerating force directed substantially parallel to the playfield board 10, as indicated by the solid arrow in FIG. 5.

Because the center of the elastic band 25 is spaced above the upper surface 11 of the playfield board 10 a distance substantially equal to the radius of the pin ball 15, this kicking impetus given to the pin ball 15 by the kicker apparatus 30 will be directed substantially through the center of the pin ball 15 parallel to the playfield board 10. Accordingly, it will be appreciated that no spin or "English" will be imparted to the pin ball 15, and since there is no downward component of the kicking force there will be no undue wear on the playfield board 10.

As the elastic band 25 moves back through its normal rest position, the actuator 75 will move back to its normal position under the urging of the leaf contact 72, thereby opening the contacts of the switch 70 and deenergizing the solenoid coil 41. The plunger rod 45 will then be reextended by the compression spring 46 and the drive crank 50 will be pivoted back to its initial position, pulling the kicker member 60 back along the track channels 35 to its initial position. Accordingly, it will be seen that the kicker member 60 undergoes a reciprocating sliding movement substantially parallel to the playfield board 10, while the solenoid plunger rod 45 remains substantially vertically oriented.

While the kicker member 60 may be formed of any suitable material, it is preferably of one-piece unitary construction, being molded of a suitable plastic material such as nylon. The frame 31, the cover plate 38 and the drive crank 50 may also be formed of plastic material.

From the foregoing, it can be seen that there has been provided an improved kicker apparatus for a slingshot bumper assembly in a pin ball game, which imparts to the pin ball a kicking force directed substantially parallel to the playfield board, while permitting the use of a drive solenoid with a vertically-disposed plunger rod.

I claim:

1. A pin ball kicker apparatus comprising a frame, a drive solenoid carried by said frame and having a reciprocating plunger, a kicker member carried by said frame for only rectilinear reciprocating movement with respect thereto along a rectilinear path disposed generally perpendicular to the axis of said solenoid plunger, and drive linkage means carried by said frame and interconnecting said drive solenoid plunger and said kicker member and responsive to actuation of said drive solenoid for effecting movement of said kicker member along said path.

2. The kicker apparatus of claim 1, wherein said drive linkage includes means pivotally mounted on said frame and coupled to said kicker member.

3. The kicker apparatus of claim 2, wherein said pivotally mounted means is engageable with said kicker member for effecting movement thereof.

4. The kicker apparatus of claim 1, wherein said kicker member is of unitary one-piece construction.

5. The kicker apparatus of claim 4, wherein said kicker member is molded of plastic.

6. The kicker apparatus of claim 1, and further including guide means on said frame defining the path and guiding the movement of said kicker member therealong.

7. A pin ball kicker apparatus comprising a frame, a drive arm mounted on said frame for pivotal movement about a predetermined pivot axis, a drive solenoid carried by said frame and including a plunger movable along a drive axis and coupled to said drive arm for effecting pivotal movement thereof, track means on said frame defining a rectilinear path disposed at a non-zero angle with respect to said drive axis, and a kicker member coupled to said drive arm and cooperating with said track means for only rectilinear reciprocating movement along said path in response to pivotal movement of said drive arm.

8. The kicker apparatus of claim 7, wherein said track means comprises a channel formed in said frame.

9. The kicker apparatus of claim 8, wherein said kicker member is disposed for sliding movement along said channel.

10. The kicker apparatus of claim 7, wherein said kicker member defines a receptacle receiving therein one end of said drive arm for engagement therewith, said kicker member having a guide portion disposed for sliding engagement with said track means.

11. The kicker apparatus of claim 7, wherein said track means includes a pair of laterally spaced-apart parallel channels formed in said frame.

12. The kicker apparatus of claim 11, wherein said drive arm is disposed between said track channels.

13. The kicker apparatus of claim 7, wherein said kicker member includes a guide portion disposed for sliding engagement along said track means, and further including retaining means for retaining said guide portion in engagement with said track means.

14. In a kicker apparatus for a slingshot bumper assembly in a pin ball game including a playfield board on which a ball rolls for engagement with a resilient impact member to actuate a drive solenoid having a plunger, the improvement comprising a frame mounted on the playfield board supporting the drive solenoid with the axis of the plunger thereof disposed at a non-zero angle with respect to the playfield board, a kicker member carried by the frame for only rectilinear reciprocating movement with respect thereto in directions substantially parallel to the playfield board, and drive linkage means interconnecting the drive solenoid plunger and said kicker member and responsive to actuation of the drive solenoid for effecting movement of said kicker member against the impact member for imparting to the associated ball a propelling force directed substantially parallel to the playfield board.

15. The kicker apparatus of claim 14, wherein said frame is disposed beneath the associated playfield board and said kicker member projects above the associated playfield board.

16. The kicker apparatus of claim 14, wherein said kicker member has a bearing surface thereon disposed substantially perpendicular to the associated playfield board for engagement with the impact member.

17. In a kicker apparatus for a slingshot bumper assembly in a pin ball game including a playfield board on which a ball rolls for engagement with a resilient impact member to actuate a pivoting drive arm, the improvement comprising a frame mounted on the playfield board supporting the drive arm for pivotal movement about an axis disposed substantially parallel to the playfield board, track means on the frame defining a rectilinear path extending substantially parallel to the playfield board, and a kicker member carried by said frame and cooperating with said track means for only rectilinear reciprocating movement along said path, said kicker member being coupled to said drive arm and responsive to actuation thereof for movement along said path into engagement with the impact member for imparting to the associated ball a propelling force directed substantially parallel to the playfield board.

18. The kicker apparatus of claim 17, wherein said kicker member includes a receptacle means for receiving therein one end of the associated drive arm for engagement therewith.

19. The kicker apparatus of claim 18, wherein said track means includes a channel formed in the top of said frame, said kicker member including a guide portion disposed in said channel for sliding movement therealong.

20. The kicker apparatus of claim 19, and further including retaining means cooperating with said frame for retaining said guide portion in said track channel.

21. The kicker apparatus of claim 20, wherein said retaining means is disposed below the associated playfield board.

22. A pin ball kicker apparatus comprising a frame, a drive arm mounted on said frame for pivotal movement about a predetermined pivot axis, drive means carried by said frame and including a drive member movable along a single drive axis and coupled to said drive arm for effecting pivotal movement thereof, track means on said frame defining a rectilinear path disposed generally perpendicular to said drive axis, and a kicker member coupled to said drive arm and cooperating with said track means for only rectilinear reciprocating movement along said path in response to pivotal movement of said drive arm.

* * * * *